US010024081B2

(12) United States Patent
Li et al.

(10) Patent No.: US 10,024,081 B2
(45) Date of Patent: Jul. 17, 2018

(54) DOOR LOCK

(71) Applicant: Yannan Guochuang Technology (Beijing) Co., Ltd., Beijing (CN)

(72) Inventors: Xiangming Li, Beijing (CN); Beining Huang, Beijing (CN); Darun Tang, Beijing (CN); Lin Zhu, Beijing (CN); Hailong Zhao, Beijing (CN); Dun Li, Beijing (CN); Gongqiu Zhang, Beijing (CN); Baopeng Hao, Beijing (CN)

(73) Assignee: YANNAN GUOCHUANG TECHNOLOGY (BEIJING) CO., LTD., Beijing (CN)

( * ) Notice: Subject to any disclaimer, the term of this patent is extended or adjusted under 35 U.S.C. 154(b) by 0 days.

(21) Appl. No.: 15/442,537

(22) Filed: Feb. 24, 2017

(65) Prior Publication Data

US 2018/0044942 A1 Feb. 15, 2018

(30) Foreign Application Priority Data

Aug. 12, 2016 (CN) ..... 2016 1 0666543

(51) Int. Cl.
*G07C 9/00* (2006.01)
*E05B 45/06* (2006.01)
(Continued)

(52) U.S. Cl.
CPC ..... *E05B 45/06* (2013.01); *E05B 17/10* (2013.01); *E05B 17/22* (2013.01); *E05B 47/00* (2013.01);
(Continued)

(58) Field of Classification Search
CPC ..... G06F 1/20; G07C 2009/00753; G07C 9/00174; G07C 9/00571; G08B 21/24;
(Continued)

(56) References Cited

U.S. PATENT DOCUMENTS

2009/0137891 A1* 5/2009 Wang ..... A61B 5/0404 600/384
2013/0229277 A1 9/2013 Liao
(Continued)

FOREIGN PATENT DOCUMENTS

CN 2747329 Y 12/2005
CN 103310517 A 9/2013
(Continued)

OTHER PUBLICATIONS

The State Intellectual Property Office of the People's Republic of China, Search Report Accompanying Office Action for counterpart application CN2016106665436, dated Feb. 8, 2018 (w/ English translation).

*Primary Examiner* — Dionne H Pendleton
(74) *Attorney, Agent, or Firm* — Brainspark Associates, LLC

(57) ABSTRACT

The disclosure discloses a door lock including a locking mechanism, a power interface, a main control board, an environmental information collection device and a power supply management device, where the locking mechanism, power interface and power supply management device are respectively connected with the main control board, the environmental information collection device connected with the power supply management device, the environmental information collection device configured to collect and transmit environmental information on the surrounding of the door lock to the power supply management device; the power supply management device configured to carry out processing according to the environmental information and output a power supply mode matched with the environmental information to the main control board; and the power interface configured to execute an operation related to the power supply mode matched with the environmental infor-
(Continued)

mation according to a power supply instruction from the main control board.

15 Claims, 2 Drawing Sheets

(51) Int. Cl.
*E05B 17/22* (2006.01)
*E05B 49/00* (2006.01)
*E05B 47/00* (2006.01)
*E05B 17/10* (2006.01)

(52) U.S. Cl.
CPC ..... *E05B 49/00* (2013.01); *G07C 9/0069* (2013.01); *G07C 9/00309* (2013.01); *G07C 9/00563* (2013.01); *E05B 2047/0048* (2013.01); *E05B 2047/0067* (2013.01); *E05B 2047/0068* (2013.01); *E05B 2047/0097* (2013.01); *G07C 2009/00579* (2013.01); *G07C 2009/00769* (2013.01)

(58) Field of Classification Search
CPC ..... H05K 7/20209; A45D 2200/20; A45D 2200/205; A45D 29/00; A45D 29/18; A45D 34/045; A61B 2560/0462; A61B 2560/0468; A61B 5/024; A61B 5/0404; A61B 5/14551; A61B 5/6826; A61B 5/6838
See application file for complete search history.

(56) References Cited

U.S. PATENT DOCUMENTS

| | | | | |
|---|---|---|---|---|
| 2016/0220006 | A1* | 8/2016 | Le | A45D 29/18 |
| 2017/0013810 | A1* | 1/2017 | Grabell | A01G 31/06 |
| 2017/0032600 | A1* | 2/2017 | Roth | G07C 9/00174 |
| 2017/0047784 | A1* | 2/2017 | Jung | H02J 50/12 |
| 2017/0162030 | A1* | 6/2017 | Rajnath | G08B 21/24 |

FOREIGN PATENT DOCUMENTS

| | | | |
|---|---|---|---|
| CN | 104156705 | A | 11/2014 |
| CN | 104537744 | A | 4/2015 |
| CN | 105321241 | A | 2/2016 |
| CN | 205063572 | U | 3/2016 |
| CN | 205427983 | U | 8/2016 |
| CN | 206162731 | U | 5/2017 |

* cited by examiner

DOOR LOCK

CROSS-REFERENCE TO RELATED APPLICATIONS

This application claims priority to Chinese Patent Application No. 201610666543.6, filed on Aug. 12, 2016, published as CN106157419A, entitled "DOOR LOCK", which is incorporated herein by reference in its entirety.

TECHNICAL FIELD

The present disclosure relates to the technical field of locksets, and in particular to a door lock.

BACKGROUND

With rapid urbanization, there is an increasing urgent need for protection of room safety. Fingerprint electronic door locks are widely received because they relieve users from the limitation of physical keys. However, since fingerprints are imitable, the safety of the door locks is greatly challenged. Furthermore, since the electronic door lock has an uninterrupted power supply, the power consumption of the door locks is relatively large, and accordingly people need to change batteries frequently, which not only wastes the energy source, but also pollutes the environment. Moreover, the existing methods for disassembling and assembling the batteries in a lockset are very troublesome. People usually need to disassemble a panel of the lockset and even need to disassemble a decorative board on the panel to change the batteries. After frequent disassembly and assembly of the batteries, screws or buckles on the panel are worn to some extent, which will affect the use of the door lock. Furthermore, once door cannot be opened due to insufficient power of the batteries of the door lock, the use of the door will be seriously affected, and thus the user experience is worse.

SUMMARY

In view of one or more problems mentioned above, embodiments of the present disclosure provide a door lock. The door lock can reduce the energy consumption of a power supply, reduce the disassembly and assembly operations and improve the user experience.

In a first aspect of the present disclosure, there is provided a door lock comprising: a locking mechanism, a power interface, a main control board, an environmental information collection device and a power supply management device, wherein the locking mechanism, the power interface and the power supply management device are respectively connected with the main control board, and the environmental information collection device is connected with the power supply management device, and wherein the environmental information collection device is configured to collect environmental information on the surrounding of the door lock and transmit the environmental information to the power supply management device; the power supply management device is configured to carry out matching operation according to the environmental information and output a power supply mode matched with the environmental information to the main control board; and the power interface is configured to execute an operation related to the power supply mode matched with the environmental information according to a power supply instruction from the main control board.

In combination with the aforementioned first aspect, in a second possible aspect, the power supply management device comprises a reference information storage module, an environmental information comparison module and a power supply mode selection module, wherein the environmental information comparison module is configured to compare the environmental information collected by the environmental information collection device with environmental reference information pre-stored in the reference information storage module and output a comparison result to the power supply mode selection module; and the power supply mode selection module is configured to select the power supply mode matched with the environmental information according to the comparison result and transmit the power supply mode to the main control board.

In combination with the aforementioned possible aspects, in a third possible aspect, the selecting of the power supply mode matched with the environmental information according to the comparison result comprises: when it is determined from the comparison result that the surrounding environment of the door lock is dynamic, outputting a regular power supply mode; or when it is determined from the comparison result that the surrounding environment of the door lock is static, outputting an energy-saving power supply mode.

In combination with the aforementioned possible aspects, in a fourth possible aspect, the environmental information comprises one or more of capacitance sensing information, resistance sensing information, sound information, thermal radiation information and illumination information.

In combination with the aforementioned possible aspects, in a fifth possible aspect, the door lock further comprises a front panel and a finger vein recognition device embedded in an opening of the front panel, wherein the finger vein recognition device is connected with the main control board, and the finger vein recognition device is configured to collect finger vein information and send the collected finger vein information to the main control board, so that the main control board carries out identity verification according to the finger vein information.

In combination with the aforementioned possible aspects, in a sixth possible aspect, the finger vein recognition device comprises: a finger accommodating cavity, an infrared light source and an infrared imaging unit, wherein the finger accommodating cavity is embedded in the opening of the front panel; and the infrared light source and the infrared imaging unit are respectively arranged on an outer side of the finger accommodating cavity.

In combination with the aforementioned possible aspects, in a seventh possible aspect, the door lock further comprises: a password keyboard connected with the main control board, and the password keyboard is configured to collect password information and send the password information to the main control board, so that the main control board carries out identity verification according to the password information.

In combination with the aforementioned possible aspects, in an eighth possible aspect, the door lock further comprises: a monitoring device connected with the main control board, and the monitoring device is configured to monitor sound information and/or image information on the outside of the door lock and send the sound information and/or the image information to the main control board.

In combination with the aforementioned possible aspects, in a ninth possible aspect, the door lock further comprises: an event management device connected with the main control board, and the event management device is configured to monitor action events of one or more components of the door lock, determine whether the action event is authorized by an authorization instruction from the main control board, and report an illegal-action-event to the main control board.

In combination with the aforementioned possible aspects, in a tenth possible aspect, the door lock further comprises: an alarm device connected with the main control board, and the alarm device is configured to generate a corresponding ringing alarm according to an illegal-action-event alarm instruction or a low power alarm instruction from the main control board.

In combination with the aforementioned possible aspects, in an eleventh possible aspect, the door lock further comprises: a wireless communication device connected with the main control board, and the wireless communication device is configured to carry out wireless information interaction with external devices.

In combination with the aforementioned possible aspects, in a twelfth possible aspect, the information interaction comprises: the main control board sends the monitored sound information and/or image information on the outside of the door lock, and/or the monitored action event of the one or more components of the door lock, and/or the ringing alarm to the external devices through the wireless communication device.

In combination with the aforementioned possible aspects, in a thirteenth possible aspect, the wireless information interaction comprises: remote monitoring and/or configuration is carried out on the door lock through the external devices, and/or unified management is carried out on the door lock through the external devices.

In combination with the aforementioned possible aspects, in a fourteenth possible aspect, the external devices comprise one or more of a mobile communication device, a computing device, a cloud serving device, a smart home appliance or a smart wearable device.

In combination with the aforementioned possible aspects, in a fifteenth possible aspect, the door lock further comprises: a front panel and a mechanical keyhole formed in the front panel in a hidden manner, and the mechanical keyhole is directly connected with the locking mechanism.

In combination with the aforementioned possible aspects, in a sixteenth possible aspect, the door lock further comprises: a front panel and electrode contacts arranged on the front panel, and the electrode contacts are directly connected with the power interface.

Therefore, in the present disclosure, the power supply mode can be flexibly adjusted according to the change of the surrounding environment of the door lock in order to effectively supply power to the door lock. Therefore, the energy consumption of the power supply can be reduced, the disassembly and assembly operation related to the power supply can be reduced and the user experience can be improved.

BRIEF DESCRIPTION OF THE DRAWINGS

To illustrate technical solutions in the embodiments of the present disclosure more clearly, a brief introduction on the accompanying drawings which are needed in the description of the embodiments of the present disclosure is given below. Apparently, the accompanying drawings described below are merely some of the embodiments of the present disclosure, based on which other drawings can be obtained by those of ordinary skill in the art without any creative effort.

DETAILED DESCRIPTION

Figure 1:
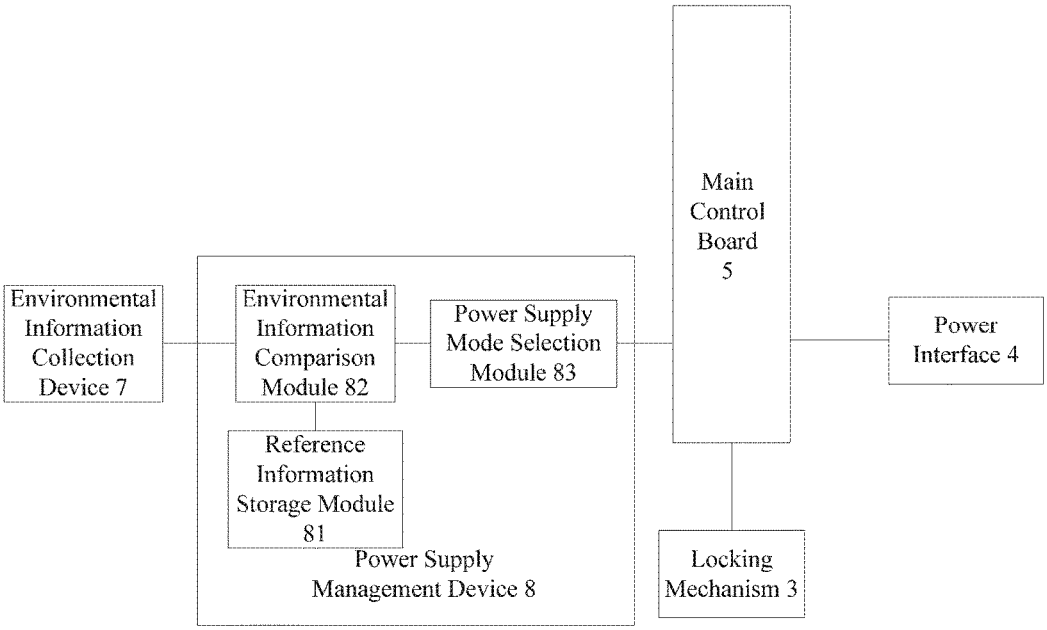
FIG. 1 is a schematic structural diagram of a door lock according to an embodiment of the present disclosure.

In order that the objects, technical solutions and advantages of the present disclosure are clearer, a clear and complete description of the technical solutions in the embodiments of the present disclosure will be given below, in combination with the accompanying drawings in the embodiments of the present disclosure. Apparently, the embodiments described below are merely a part, but not all, of the embodiments of the present disclosure. All of other embodiments, obtained by those of ordinary skill in the art based on the embodiments in the present disclosure without any creative effort, fall into the protection scope of the present disclosure.

The features and exemplary embodiments of various aspects of the present disclosure are described below in detail. In the following detailed description, numerous specific details are set forth in order to provide a thorough understanding of the present disclosure. It will be apparent, however, to those skilled in the art that the present disclosure can be implemented without some of these specific details. The following description of the embodiments is provided merely for providing a better understanding of the present disclosure by illustrating examples of the present disclosure. The present disclosure is in no way limited to any particular configuration or procedure set forth below, but is intended to cover any modifications, substitutions and improvements of elements, components and procedures without departing from the spirit of the present disclosure. In the drawings and the following description, well-known structures and techniques are not shown in order to avoid unnecessarily obscuring the present disclosure.

Exemplary embodiments will now be described more fully with reference to the accompanying drawings. However, the exemplary embodiments can be implemented in many forms and should not be construed as being limited to the embodiments set forth herein; on the contrary, these embodiments are provided so that the present disclosure will be thorough and complete, and the concepts of the exemplary embodiments are fully conveyed to those skilled in the art. Identical reference signs in the drawings represent identical or similar structures, and thus a detailed description thereof will be omitted.

Furthermore, the described features, structures or characteristics can be combined in one or more embodiments in any suitable manner. In the following description, numerous specific details are set forth in order to provide a thorough understanding of the embodiments of the present disclosure. However, those skilled in the art will recognize that the technical solutions of the present disclosure can be implemented without one or more of the specific details, or other components, modules or materials or the like may be employed. In other situations, well-known structures, materials or operations are not shown or described in detail to avoid obscuring the primary technical idea of the present disclosure.

It should be noted that, in the case of no conflict, the embodiments of the present application and the features in the embodiments can be combined with each other. Hereinafter, the present application will be described in detail with reference to the accompanying drawings and in combination with the embodiments.

FIG. 1 is a schematic structural diagram of a door lock according to an embodiment of the present disclosure. As shown in FIG. 1, the door lock can comprise: a locking mechanism 3, a power interface 4, a main control board 5, an environmental information collection device 7 and a power supply management device 8.

In the present embodiment, a physical connection relationship of the components of the door lock can be as follows: the locking mechanism 3, the power interface 4 and the power supply management device 8 are respectively connected with the main control board 5, and the environmental information collection device 7 is connected with the power supply management device 8.

In the present embodiment, the configuration of the components of the door lock can be as follows: the environmental information collection device 7 is configured to collect environmental information on the surrounding of the door lock and transmit the environmental information to the power supply management device 8. The power supply management device 8 is configured to carry out matching operation according to the environmental information and output a power supply mode matched with the environmental information to the main control board 5. The power interface 4 is configured to execute an operation related to the power supply mode matched with the environmental information according to a power supply instruction from the main control board 5.

In the present embodiment, when a user opens a door by the door lock, the operation of the components of the door lock can be shown as follows.

Firstly, the environmental information collection device 7 collects the environmental information on the surrounding of the door lock and transmits the environmental information to the power supply management device 8.

Then, the power supply management device 8 carries out the matching operation according to the environmental information and outputs the power supply mode matched with the environmental information to the main control board 5.

After that, the power interface 4 executes the operation related to the power supply mode matched with the environmental information according to the power supply instruction from the main control board 5.

The environmental information collected by the environmental information collection device 7 can be one or more of capacitance sensing information, resistance sensing information, sound information, thermal radiation information and illumination information. According to different types of information to be collected, the environmental information collection device 7 can comprise different sensing devices (e.g., a sound sensor, an infrared thermal radiation sensor or a photosensitive sensor or the like) or switching devices (e.g., a capacitive touch switch or a resistive touch switch or the like). Specifically, the capacitance sensing information can be collected by using the capacitive touch switch. The capacitive touch switch can accurately detect effective touch of a finger through an insulating material (glass, plastic or the like) housing of more than 20 mm, thereby guaranteeing that the sensitivity, stability, reliability and the like of a product will not change due to the changes of environmental conditions or long term use, and ensuring water resistance and strong anti-interference. Similarly, the resistance sensing information can be collected by using the resistive touch switch. It can be understood that those skilled in the art can use other sensors to collect the corresponding environmental information according to needs.

In some embodiments, the power supply management device 8 can comprise a reference information storage module 81, an environmental information comparison module 82 and a power supply mode selection module 83. The environmental information comparison module 82 can be configured to compare the environmental information collected by the environmental information collection device 7 with environmental reference information pre-stored in the reference information storage module 81 and output a comparison result to the power supply mode selection module 83. The power supply mode selection module 83 can be configured to select the power supply mode matched with the environmental information according to the comparison result and transmit the power supply mode to the main control board 5.

In some embodiments, the selecting of the power supply mode matched with the environmental information according to the comparison result comprises: when it is determined from the comparison result that the surrounding environment of the door lock is dynamic, outputting a regular power supply mode (e.g., an all-components power supply mode, i.e., a power supply mode in which a normal rated voltage is provided to all components of the door lock); or when it is determined from the comparison result that the surrounding environment of the door lock is static, outputting an energy-saving power supply mode.

Specifically, for example, the energy-saving power supply mode comprises but not limited to a partial-components power supply mode, in which some components (e.g., the environmental information collection device 7 and the main control board 5) in the door lock are powered, but the others are not powered. As another example, power supply with a voltage lower than a rated voltage is provided for some components, and regular power supply is provided for the other components.

The power supply management device 8 can be specifically designed as follows.

For example, when the capacitive touch switch detects a finger touch of the user, it is determined that the environment is dynamic, which indicates that the user may be in need of unlocking and thus a rated supply voltage shall be provided for the respective components of the door lock.

For example, when the sound intensity is less than 20 dB, it is determined that the environment is static and thus there is no unlocking need at the moment. The rated supply voltage does not need to be provided, and only an operating voltage shall be provided for the environmental information collection device 7 and the main control board 5. When the sound intensity is greater than or equal to 20 dB, it is determined that the environment is dynamic, which indicates that there may be an unlocking need at the moment and thus the rated supply voltage shall be provided for the respective components of the door lock.

As another example, when human body thermal radiation is sensed by an infrared sensing device, it is determined that the environment is dynamic and someone approaches the door lock. There may be the unlocking need at the moment, and then the rated supply voltage shall be provided for the respective components of the door lock. As another example, when the power supply management device determines that the surrounding environments of the door lock are static within a preset time period, it assumes that the user may be on holiday and outputs a power supply mode in which the entire door lock will be powered off. The door lock cannot be used in the mode. Only after the door lock is restarted, the door lock can return to a normal operating state. For example, the preset time period may be 24 hours. Usually, a home lock or a business lock will be unlocked at least once within 24 hours. Therefore, if no operation is carried out on the door lock within 24 hours, it indicates that the user using the door lock has been on holiday. In this case, further supplying power to the door lock will cause electric energy waste. Certainly, the preset time period can also be flexibly set according to actual needs. For example, the preset time period is set to be longer or shorter than the above value. In the energy-saving power supply mode, the door lock can operate in a monitoring mode and a sleep mode. In a power-off mode, the door lock can be in a deep sleep state. The specific power supply mode can be flexibly set according to actual needs.

In some embodiments, the environmental reference information pre-stored in the reference information storage module 81 can be as shown in the following table:

TABLE 1

Sound Intensity Reference Information Table

| Sound Intensity Reference Numerical Range (unit: dB) | Time (unit: hour) | Power Supply Mode |
|---|---|---|
| ≤20 | ≤24 | Energy-saving power supply mode |
| >20 | ≤24 | Regular power supply mode |
| ≤20 | >24 | Power-off power supply mode |

Those skilled in the art can understand that the table of the environmental reference information can comprise reference information tables of various environmental parameters, or the reference information of the various environmental parameters can be recorded in one single table. Personalized settings can be specifically carried out according to needs, and the contents in this aspect are not limited.

Therefore, in the present disclosure, the power supply mode can be flexibly adjusted according to the change of the surrounding environment of the door lock, to effectively supply power to the door lock. Therefore, the electric energy can be greatly saved, and the times for changing the power supply can be reduced. Furthermore, the workload of the user can be reduced, the service life of the door lock can be extended and the user experience can be improved.

Figure 2:
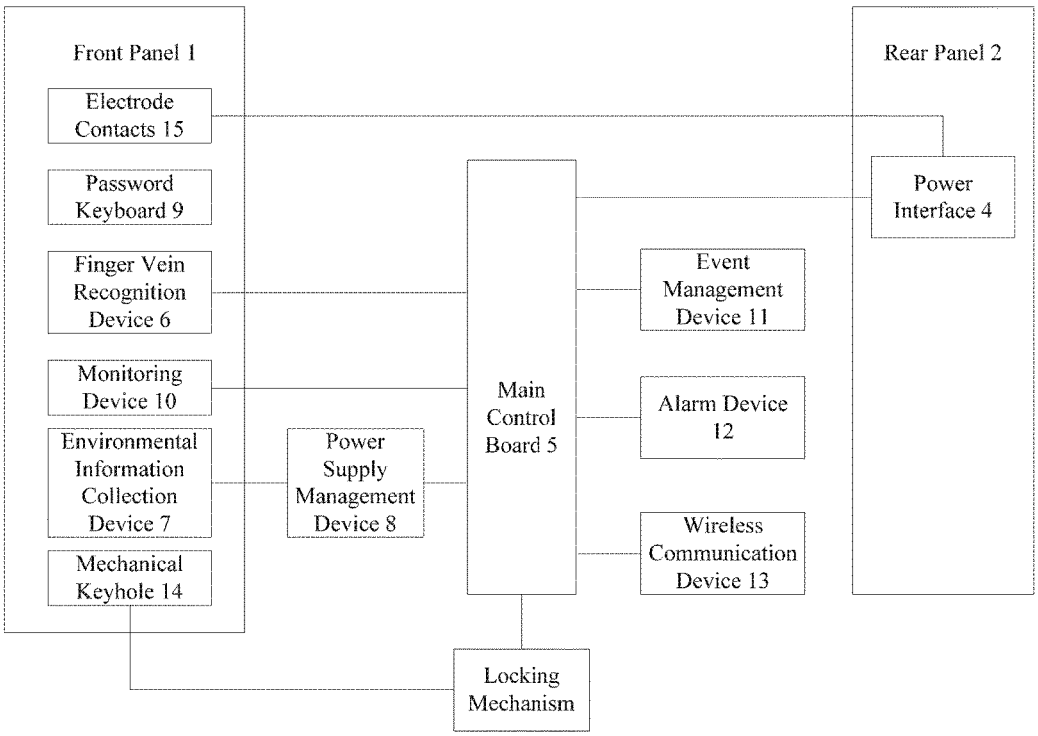
FIG. 2 is a schematic structural diagram of a door lock according to another embodiment of the present disclosure.

FIG. 2 is a schematic structural diagram of a door lock in another embodiment of the present disclosure. As shown in FIG. 2, the door lock can comprise the following components: a front panel 1, a rear panel 2, a locking mechanism 3, a power interface 4, a main control board 5, a finger vein recognition device 6, an environmental information collection device 7, a power supply management device 8, a password keyboard 9, a monitoring device 10, an event management device 11, an alarm device 12, a wireless communication device 13, a mechanical keyhole 14 and electrode contacts 15 (two electrodes, i.e., a positive electrode and a negative electrode respectively).

In the present embodiment, a number of functional components are added on the basis of the embodiment as shown in FIG. 1, so that the door lock has more powerful functions. For the brevity of description, identical or similar contents with those in the embodiment as shown in FIG. 1 will not be repeated herein, and only the following components added on the basis of FIG. 1 will be described as follows: the front panel 1, the rear panel 2, the finger vein recognition device 6, the password keyboard 9, the monitoring device 10, the event management device 11, the alarm device 12, the wireless communication device 13, the mechanical keyhole 14 and the electrode contacts 15.

In the present embodiment, the physical positions and connection relationships of the added components mentioned above can be shown as follows.

The front panel 1 can be installed on a door from outside, and the rear panel 2 can be installed on the door from inside. The finger vein recognition device 6, the password keyboard 9, the monitoring device 10, the event management device 11, the alarm device 12 and the wireless communication device 13 can be respectively connected with the main control board 5. The mechanical keyhole 14 can be directly connected with the locking mechanism 3. The electrode contact 15 can be directly connected with the power interface 4. The finger vein recognition device 6, the environmental information collection device 7, the password keyboard 9, the monitoring device 10, the mechanical keyhole 14 and the electrode contact 15 can be embedded in openings in the front panel 1, directly arranged on any position on the front panel 1, or arranged on the periphery of the front panel 1, etc. The power interface 4 can be embedded in an opening in the rear panel 2, directly arranged on any position on the rear panel 2, or arranged on the periphery of the rear panel 2, etc. The event management device 11, the alarm device 12 and the wireless communication device 13 can be arranged on positions between the front panel 1 and the rear panel 2. The specific positions in this regard are not limited.

In the present embodiment, the front panel 1 and the rear panel 2 of the door lock can use zinc alloy material. The zinc alloy is formed by adding other elements into the basis zinc. The commonly added alloy elements comprise aluminum, copper, magnesium, cadmium, lead, titanium and other elements that can form low-temperature zinc alloys. The zinc alloy has low melting point and good fluidity, is feasible for fusion welding, brazing and plastic processing, and has corrosion resistant in the atmosphere. The residual of zinc alloy can be recycled and re-melted conveniently. Certainly, the door lock can also use traditional copper, steel, iron and other materials. Circuit elements in the door lock can use electronic plastic and other materials.

In the present embodiment, the configuration of the components of the door lock can be as follows.

The finger vein recognition device 6 is configured to collect finger vein information and send the collected finger vein information to the main control board 5, so that the main control board 5 can carry out identity verification according to the finger vein information. Specifically, the main control board can compare the collected finger vein information with the finger vein information of the user stored therein. It is determined that the identity verification is successful when the collected finger vein information and the stored finger vein information are matched. Further detail of this part will be illustrated below.

In the present embodiment, the monitoring device 10 is configured to monitor sound information and/or image information on the outside of the door lock and send the detected sound information and/or the detected image information to the main control board 5. Specifically, a camera can be used to record the conditions on the outside of the door lock, and thus the user can monitor the conditions around the door of a house or a company in real time through a mobile phone, a computer and other devices, which is very convenient.

In the present embodiment, the event management device 11 is configured to monitor action events of one or more components of the door lock, determine whether these action events are authorized by authorization instructions from the main control board 5 and report illegal-action-event (including, but not limited to: an unauthorized door opening event) to the main control board 5.

In the present embodiment, the alarm device 12 is configured to generate a corresponding ringing alarm according to an illegal-action-event alarm instruction or a low power alarm instruction from the main control board 5. The alarm device 12 can be specifically configured to: send a warning to the mobile phone of the user when the power of the door lock is too low, when it is in a dormant mode or a deep sleep mode, and send a voice prompt of immediately changing the battery to the user when the user uses the door lock.

The wireless communication device 13 is configured to carry out wireless information interaction with external devices. The external devices comprise one or more of a mobile communication device, a computing device, a cloud serving device, a smart home appliance or a smart wearable device. Specifically, for example, the external device is, but not limited to, a mobile phone, a computer, a tablet computer, a cloud server, a smart TV or a smart band, etc.

In the present embodiment, the specific form of the information interaction can be as follows: the main control board sends the monitored sound information and/or image information on the outside of the door lock, and/or the monitored action event of the one or more components of the door lock, and/or the ringing alarm to the external devices through the wireless communication device.

In some optional embodiments, the specific form of the information interaction can be as follows: remote monitoring and/or configuration is carried out on the door lock through the external devices, and/or unified management is carried out on the door lock through the external devices.

Specifically, the user can configure and remotely monitor the door lock by an APP in the mobile phone. Unified management and control (for example, but not limited to: unified registration of identity information and password information of users, unified verification on the user identity, monitoring of information on the surrounding of the door lock, and modification, addition and deletion of the functions of the door lock) are carried out on the door lock through a door lock management platform in a computer, a tablet computer or a cloud server. The communication protocol for the information interaction can be: a Bluetooth communication protocol, a WiFi communication protocol, a Zigbee communication protocol, a 433 MHz radio frequency communication protocol, etc. The door locks can be classified as home version door locks and enterprise version door locks. When the door lock is the home version door lock, the user can realize short range information interaction of the mobile phone and the door lock by using the Bluetooth communication protocol. For example, the user can carry out door lock parameter configuration, user registration and the like. When the door lock is the enterprise version door lock, the user can connect the door lock with internet by WiFi to carry out remote control on the door lock.

The APP or a program in the door lock management platform can be set to fulfill the functional requirements as follows.

1. Finger vein registration can be implemented (for example, the number of registrants is 50, and visitor permission authorization is supported within a certain time limit).

2. Passwords can be set (for example, one main user password, and a plurality of temporarily authorized visitor passwords with limited valid periods or limited valid times).

3. A main user can add, delete, modify or check the registered finger vein or password after passing the verification to operate in an administrator authentication mode (through the finger vein or the password).

4. Registered users can be added, deleted, modified or checked through the APP.

5. The door lock configuration can be changed through the APP.

6. The door lock can be digitally initialized.

7. An indoor safe mode (i.e., the power-off mode) can be set or canceled manually or by using a communication terminal.

8. A sound mode can be set or deleted.

9. An automatic locking function after door closing can be set.

10. An automatic locking time can be set.

11. An invasion sensing function can be set in which when the door lock is compulsively opened from inside or outside of the house, alarm sound is generated, and automatic alarm is executed.

12. A battery change reminding function can be set.

13. A two-factor authentication safety mode can be set.

14. An anti-mischief mode can be set (when wrong passwords are input for 5 times, the electronic lock will generate the alarm sound and automatically stop operating for 3 minutes).

It can be understood that, if the functions of the door lock need to be modified, added or deleted, it can be realized by modifying the program in the APP or the door lock management platform.

In the present embodiment, the password keyboard 9 is configured to collect password information and send the password information to the main control board 5, so that the main control board 5 carries out identity verification according to the password information. Specifically, the main control board 5 can compare the collected password information with the password information of the user stored therein. It is determined that the identity verification is successful if the collected password information and the stored password information are matched. Key numbers on the password keyboard 9 can be displayed with backlight, and the backlight can be wakened up when a hand is about to touch the password keyboard.

In the present embodiment, the user can use the door lock management platform to uniformly set the passwords or can set the passwords via the communication terminal. The password forms can be freely set. For example, the password can be set effective with a certain times or within a certain time period. This manner is generally used for setting the passwords used by visitors.

The existing password on the door lock is fixed, and the passwords of respective users are same. Therefore, the password leakage situation is serious. In view of the password leakage problem, the present disclosure carries out the following special processing on the cryptographic algorithm.

In one aspect, the password can have a messy code function. That is, arbitrary virtual passwords can be added before and after the door opening password, and the system automatically extracts the real password.

In another aspect, the passwords may not be one single password and may be associated with the respective registered users.

In a further aspect, variable numbers are added before each password. For example, date numbers are added before the password.

Therefore, the password leakage can be prevented, and the safety performance of the door lock is improved.

Specifically, the user may open the door lock by using the password in the following way. The user approaches the door lock, touches a position of a keyboard to wake up the keyboard and inputs the password for authentication (or verification). After it is determined the authentication is successful, the locking mechanism start operating, and verification pass information is uploaded to the cloud via Bluetooth or WiFi and is pushed to the App in the door lock management platform or the communication terminal (e.g., the mobile phone of the user), so that the user carries out information interaction with the door lock through the App.

Thus, in addition to the finger vein authentication of the user identity, the door lock in the present embodiment can authenticate the identity of the user again through the password. Such two factor configuration can further ensure the safety performance of the door lock. Furthermore, the door lock can verify the user identity according to one of the finger vein and the password. Such flexible configuration can prevent the problem that unregistered legitimate users cannot enter the door freely, thereby improving the user experience.

In the present embodiment, the power interface 4 can be a battery box. A power supply (e.g., 8 AA alkaline batteries) can be pre-placed in the battery box. Alternatively, no battery is placed, or the power supply can be installed by the user after the door lock is installed. The battery box can be opened easily, so that the user can easily install or change the battery in the lock body from the inside of the house. When the power of the door lock is too low, the warning will be sent to the mobile phone of the user, and furthermore when the user uses the door lock next time, the user is informed to immediately change the battery. Specifically, it can be set that reminding is activated when the power is less than 15%. The reminding is a sound warning of insufficient power, and the App pushes battery change information. When the power is less than 5%, the door lock automatically shuts down.

In the present embodiment, the electrode contacts 15 are two exposed electrode contacts 15 on the front panel 1 at the outside, and the electrode contacts 15 are directly connected with the power interface 4. In a shutdown case, the user can go to a nearby convenience store or supermarket to buy an emergency battery (9V) and connect the same to the electrode contacts to provide temporary power supply. After the user opens the door, the user can change the 8 AA alkaline batteries or charge the door lock by a charger (in this case, the power supply shall be a rechargeable battery). The inside part can be provided with an interface for external portable power sources. Accordingly, the door lock can be powered by an external portable power source for a long time, and the portable power source can be hanged on an inside holder of the door lock. For the convenience and economy, the user can also choose AA rechargeable batteries that can be charged repeatedly. Due to this design, the batteries do not need to be disassembled or changed, which reduces the damage to the door lock, prolongs the service life of the door lock and improves the user experience.

In the present embodiment, the mechanical keyhole 14 is formed in the front panel 1 in a hidden manner, and the mechanical keyhole 14 is directly connected with the locking mechanism 3. The door lock can also be provided with a plurality of mechanical keys (e.g., five mechanical keys) matched with the mechanical keyhole 14. The door lock becomes an ordinary mechanical door lock in the case of a fault or power off of an electronic device in the door lock, and at this time, the user can use the mechanical key to open the door. As a result, the door lock has a smart design, and the user can easily deal with some extreme situations, thus the user experience is greatly improved.

In some optional embodiments, any one or more of the password keyboard 9, the monitoring device 10, the event management device 11, the alarm device 12, the wireless communication device 13, the mechanical keyhole 14 and the electrode contacts 15 can be added on the basis of FIG. 1. As a result, these components can be combined in different forms to achieve corresponding functions. For the simplicity of description, the various combinations will not be described here repeatedly. In addition, in order to obtain more functions, a redundant interface can also be provided in the main control board such that further components can be increased in future according to needs and thus the performance of the door lock is improved.

Figure 3:
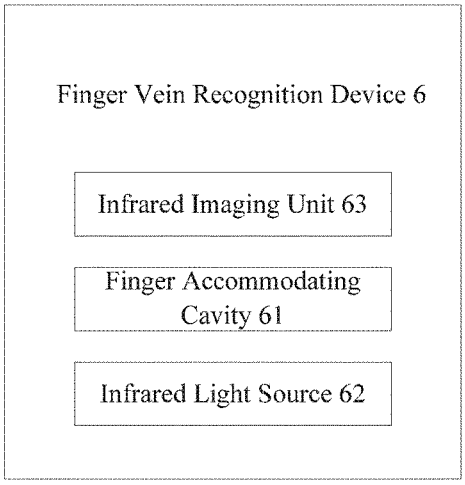
FIG. 3 is a schematic structural diagram of a finger vein recognition device according to an embodiment of the present disclosure.

FIG. 3 is a schematic structural diagram of a finger vein recognition device in one embodiment of the present disclosure. As shown in FIG. 3, the finger vein recognition device 6 can comprise a finger accommodating cavity 61, an infrared light source 62 and an infrared imaging unit 63.

The finger accommodating cavity 61 can be embedded in an opening of the front panel, and the infrared light source 62 and the infrared imaging unit 63 are respectively arranged on the outer side of the finger accommodating cavity 61. The finger accommodating cavity 61 can be made of transparent plastic, glass and other transparent materials.

Therefore, since the finger accommodating cavity 61 is embedded in the opening of the front panel (the opening adapts to the size of a finger, so that when the finger is inserted into the opening, external light cannot enter the opening) instead of being arranged in an open window. Therefore, the light emitted by the infrared light source 62 can be fully used, the interference of other light can be reduced, and the configuration requirements on the infrared light source 62 and the production cost can also be reduced. Certainly, the finger accommodating cavity 61 can also be arranged at other places. For example, it can be arranged in an open window. Such design can also solve the problem, but cannot realize the aforementioned effects.

Furthermore, the finger vein recognition device 6 can display with a bi-color lamp. Continuous light in green indicates being normally on standby, and blinking in green indicates that authentication is in progress. After it is determined the verification is successful, continuous light in green can indicate being still on standby, and a short prompt tone is emitted once; blinking in red indicates that the power is low (less than 15%), and a long prompt tone lasts for 3 seconds; and if it is determined the verification is not successful, the blinking in red is emitted once, and the short prompt tone is emitted twice.

The finger vein collection collects finger vein features of living persons, and thus can prevent counterfeiting as compared to fingerprints and other non-living features. Therefore, the present embodiment can accurately confirm the identity of the user by verifying the finger vein, thereby realizing a function of free entry without key, greatly improving the protection safety of the door lock and reinforcing the reliability of the door lock.

It can be understood that the finger vein recognition device can not only identify the finger vein, but also can identify the veins of other parts of the human body, such as palm vein, facial vein and the like. The finger accommodating cavity can be changed to corresponding devices in the specific product designs. Furthermore, the present disclosure can also add the combination of one or more of these functional modules consisting of a fingerprint collection module, an iris collection module, a facial information collection module and an ear print collection module.

Figure 4A:
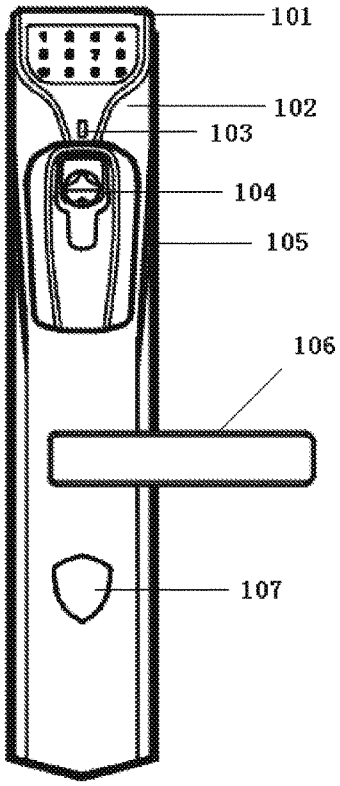
FIG. 4A is an external structure diagram of an outside part of a door lock according to an embodiment of the present disclosure.

FIG. 4A is an external structure diagram of an outside part of a door lock in an embodiment of the present disclosure. As shown in FIG. 4A, a password keyboard 101, a decorative block 102, an indicator lamp 103, a finger vein recognition device 104, a side sound-amplify-and-transmit hole 105, a handle 106, a decorative shield 107, the mechanical keyhole and an emergency backup battery interface (hidden in the front panel, or directly arranged on the front panel) can be arranged on the front panel from top to bottom.

Figure 4B:
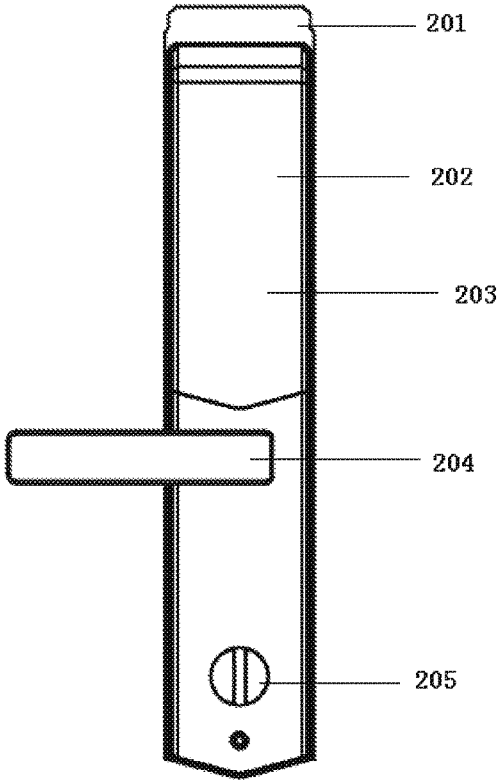
FIG. 4B is an external structure diagram of an inside part of a door lock according to an embodiment of the present disclosure.

FIG. 4B is an external structure diagram of an inside part of a door lock in an embodiment of the present disclosure. As shown in FIG. 4B, a display screen 201, a decorative block 202, a battery cover 203, a handle 204 and an deadlock button 205 (can be used for the indoor safe mode) can be arranged on the rear panel from top to bottom. Furthermore, the battery box, a setting button, a volume button, a rest key, a wireless communication device, the holder and the like can also be arranged on the rear panel in the hidden manner.

It should be noted that, some components of the door lock in the present embodiment have different reference signs from the components in FIGS. 1 and 2 respectively, but they can represent the same components. For example, the finger vein recognition device 104 and the finger vein recognition device 6 represent the same component. Furthermore, the handle 106 and the handle 204 can be the same or different. In the present embodiment, both of the handles can be a downward rotating handle, the handle part can be a metal unit, which meets the body mechanics and the streamlined design, and an anti-freezing and antistatic rubber sleeve can be sleeved thereon in winter.

The deadlock button 205 is configured to: when the user presses the deadlock button from inside of the house, the door lock monitors whether a lock cylinder in the locking mechanism is in a return state. When the lock cylinder is in the return state, the door cannot be directly closed. If the lock cylinder is in the return state, a deadlock mode is activated, the door lock is in a deep sleep power-saving mode (safe mode), the door lock cannot be wakened up by any unlocking mode from outside of house, and the mechanical lock cylinder part is locked up. The user can rotate the handle from inside of the house to release the deadlock, and the door lock will be in the dormant state again.

The emergency backup battery interface can be the battery interface mentioned above, and thus will not be repeated redundantly herein.

The operating process of the door lock will be illustrated below in detail.

1. A finger vein smart door lock is in the dormant state when it normally locks, and the outside handle is in an unavailable state. When it is monitored that someone approaches, the door lock will be automatically wakened up and enters a monitoring mode. When the user unlocks the door lock by using the finger vein recognition device, the finger vein recognition device enters a collection and verification mode. When the uses unlocks the door lock by using the keyboard, the keyboard automatically activates the backlight when the hand is about to touch the keyboard, and enters a password verification mode. When it is determined that the verification is successful in both of the two modes (or successful in any one of the two modes), the door lock automatically unlocks, and the outside handle turns into an available state. At this time, the user can use the outside handle to open the door and enter the room, and then the door lock enters a lock cylinder monitoring mode.

2. When the door lock senses a lock cylinder retraction action which indicates that the user has closed the door, the door lock automatically locks 2 seconds later, and the outside handle turns into the unavailable state again.

3. If the user does not close the door tightly (only the lock cylinder retraction is sensed in the lock cylinder monitoring mode, and it is not sensed that the lock cylinder returns within 2 seconds), a long prompt tone is emitted to remind the user to close the door tightly.

4. If the user just touches the door lock unintentionally in an open door state and then causes the lock cylinder to extend, the inside handle can be rotated to retract the lock cylinder.

5. When the door lock is in the lock cylinder monitoring mode for continuous 5 seconds, the door lock enters the dormant mode again.

6. When the user presses the deadlock button from inside of the house, the door lock monitors whether the lock cylinder is in the return state. When the lock cylinder is in the return state, the door cannot be directly closed.

7. If the lock cylinder is in the return state, the deadlock mode is opened. The door lock is in the deep sleep power-saving mode (the safe mode) and cannot be wakened up through any of outside unlocking means, and the mechanical lock cylinder is locked.

8. The user rotates the handle from inside of the house to release it from the deadlock function, and the door lock enters the dormant state again.

In the present embodiment, the reacting and unlocking times of the door lock can be set as follows.

1. In the dormant mode, the door lock monitors the approach of the user by human body sensing. The door lock can be automatically wakened up within one second and enter the monitoring mode.

2. The finger vein recognition device only needs less than 2 seconds to accomplish finger vein image collection and verification when the user starts inserting the hand.

3. The lock cylinder will unlock within 0.5 second after it is determined the finger vein verification is successful.

Those of ordinary skill in the art will recognize that the components, modules, methods, and program steps of the various examples described in combination with the embodiments disclosed herein can be implemented in electronic hardware, computer software, or a combination of both, and in order to clearly illustrate the interchangeability of hardware and software, the components and steps of the examples have been described generally in terms of functionality in the foregoing description. Whether these functions are implemented in hardware or software depends on the specific application and design constraints of the technical solutions. Those skilled in the art can use different methods to implement the described functions for each specific application, but such implementation is considered as a departure from the scope of the present disclosure.

In the several embodiments provided in the present application, it should be understood that, the disclosed apparatus can be implemented in other manners. For example, the apparatus embodiments described above are merely exemplary, e.g., the division of the components is only a logic function division, other division manners can exist in practical implementation, for example, a plurality of components or modules can be combined or integrated to another apparatus, or some features can be omitted or not implemented. In addition, the displayed or discussed mutual connection (or coupling) can be indirect coupling or communication connection through some interfaces, apparatuses or components, and can be in electrical, mechanical or other forms.

The units described as separate components can be separated physically or not, components displayed as units can be physical units or not, namely, can be located in one place, or can be distributed on a plurality of network units. Some or all of the units can be selected to implement the purposes of the solutions in the embodiments according to actual needs.

In addition, the functional units in the embodiments of the present disclosure can be integrated in one processing component, or the components separately exist physically, or two or more components are integrated in one component. The integrated component can be implemented in the form of hardware, and can also be implemented in the form of a software functional unit.

The foregoing descriptions are merely specific embodiments of the present disclosure, rather than limiting the protection scope of the present disclosure. Any person skilled in the art could readily think of various equivalent modifications or substitutions within the disclosed technical scope of the present disclosure, and these modifications or substitutions shall fall within the protection scope of the present disclosure. Accordingly, the protection scope of the claims should be defined by the protection scope of the present disclosure.

What is claimed is:

1. A door lock, comprising: a locking mechanism, a power interface, a main control board, an environmental information collection device and a power supply management device, wherein the locking mechanism, the power interface and the power supply management device are respectively connected with the main control board, and the environmental information collection device is connected with the power supply management device, and wherein the environmental information collection device is configured to collect environmental information on the surrounding of the door lock and transmit the environmental information to the power supply management device;

the power supply management device is configured to carry out matching operation according to the environmental information and output a power supply mode matched with the environmental information to the main control board; and the power interface is configured to execute an operation related to the power supply mode matched with the environmental information according to a power supply instruction from the main control board;

a front panel and a finger vein recognition device embedded in an opening of the front panel, wherein the finger vein recognition device is connected with the main control board, and the finger vein recognition device is configured to collect finger vein information and send the collected finger vein information to the main control board, so that the main control board carries out identity verification according to the finger vein information, wherein the finger vein recognition device comprises: a finger accommodating cavity, an infrared light source and an infrared imaging unit, wherein:

the finger accommodating cavity is embedded in the opening of the front panel; and the infrared light source and the infrared imaging unit are respectively arranged on the outer side of the finger accommodating cavity.

2. A door lock, comprising: a locking mechanism, a power interface, a main control board, an environmental information collection device and a power supply management device, wherein the locking mechanism, the power interface and the power supply management device are respectively connected with the main control board, and the environmental information collection device is connected with the power supply management device, and wherein the environmental information collection device is configured to collect environmental information on the surrounding of the door lock and transmit the environmental information to the power supply management device;

the power supply management device is configured to carry out matching operation according to the environmental information and output a power supply mode matched with the environmental information to the main control board; and the power interface is configured to execute an operation related to the power supply mode matched with the environmental information according to a power supply instruction from the main control board, wherein the power supply management device comprises a reference information storage module, an environmental information comparison module and a power supply mode selection module, wherein the environmental information comparison module is configured to compare the environmental information collected by the environmental information collection device with environmental reference information prestored in the reference information storage module and output a comparison result to the power supply mode selection module; and the power supply mode selection module is configured to select the power supply mode matched with the environmental information according to the comparison result and transmit the power supply mode to the main control board, wherein the selecting of the power supply mode matched with the environmental information according to the comparison result comprises:

when it is determined from the comparison result that the surrounding environment of the door lock is dynamic, outputting a regular power supply mode; or when it is determined from the comparison result that the surrounding environment of the door lock is static, outputting an energy-saving power supply mode.

3. The door lock according to claim 2, wherein the environmental information comprises one or more of capacitance sensing information, resistance sensing information, sound information, thermal radiation information and illumination information.

4. The door lock according to claim 2, further comprising: a front panel and a finger vein recognition device embedded in an opening of the front panel, wherein the finger vein recognition device is connected with the main control board, and the finger vein recognition device is configured to collect finger vein information and send the collected finger vein information to the main control board, so that the main control board carries out identity verification according to the finger vein information.

5. The door lock according to claim 2, wherein the finger vein recognition device comprises: a finger accommodating cavity, an infrared light source and an infrared imaging unit, wherein:

the finger accommodating cavity is embedded in the opening of the front panel; and the infrared light source and the infrared imaging unit are respectively arranged on the outer side of the finger accommodating cavity.

6. The door lock according to claim 2, further comprising:

a password keyboard connected with the main control board, wherein the password keyboard is configured to collect password information and send the password information to the main control board, so that the main control board carries out identity verification according to the password information.

7. The door lock according to claim 2, further comprising: a front panel and a mechanical keyhole formed in the front panel in a hidden manner, wherein the mechanical keyhole is directly connected with the locking mechanism.

8. The door lock according to claim 2, further comprising: a front panel and electrode contacts arranged on the front panel, wherein the electrode contacts are directly connected with the power interface.

9. The door lock according to claim 2, further comprising:

a monitoring device connected with the main control board, wherein the monitoring device is configured to monitor sound information and/or image information on the outside of the door lock and send the sound information and/or the image information to the main control board.

10. The door lock according to claim 9, further comprising:

an event management device connected with the main control board, wherein the event management device is configured to monitor action events of one or more components of the door lock, determine whether the action event is authorized by an authorization instruction from the main control board, and report an illegal-action-event to the main control board.

11. The door lock according to claim 10, further comprising:

an alarm device connected with the main control board, wherein the alarm device is configured to generate a corresponding ringing alarm according to an illegal-action-event alarm instruction or a low power alarm instruction from the main control board.

12. The door lock according to claim 11, further comprising:

a wireless communication device connected with the main control board, wherein the wireless communication device is configured to carry out wireless information interaction with external devices.

13. The door lock according to claim 12, wherein the wireless information interaction comprises:

the main control board sends the monitored sound information and/or image information on the outside of the door lock, and/or the monitored action event of the one or more components of the door lock, and/or the ringing alarm to the external devices through the wireless communication device.

14. The door lock according to claim 12, wherein the information interaction comprises:

remote monitoring and/or configuration is carried out on the door lock through the external devices, and/or unified management is carried out on the door lock through the external devices.

15. The door lock according to claim 14, wherein the external devices comprise one or more of a mobile communication device, a computing device, a cloud serving device, a smart home appliance or a smart wearable device.

* * * * *